US008890043B2

(12) United States Patent
Cohe et al.

(10) Patent No.: US 8,890,043 B2
(45) Date of Patent: Nov. 18, 2014

(54) STEERING SECTION FOR GUIDED MUNITION

(71) Applicant: TDA Armements S.A.S., La Ferte Saint-Aubin (FR)

(72) Inventors: Patrick Cohe, Neuvy En Sullias (FR); Bertrand Dubois, Olivet (FR); Fabien Moreau, La Ferte Saint-Aubin (FR)

(73) Assignee: TDA Armements, La Ferte St Aubin (FR)

( * ) Notice: Subject to any disclaimer, the term of this patent is extended or adjusted under 35 U.S.C. 154(b) by 164 days.

(21) Appl. No.: 13/750,573

(22) Filed: Jan. 25, 2013

(65) Prior Publication Data

US 2013/0193265 A1 Aug. 1, 2013

(30) Foreign Application Priority Data

Jan. 27, 2012 (FR) ..... 12 00246

(51) Int. Cl.

| | |
|---|---|
| ***F42B 15/01*** | (2006.01) |
| ***F42B 10/64*** | (2006.01) |
| ***F42B 10/14*** | (2006.01) |
| ***F42B 10/18*** | (2006.01) |
| ***F42B 10/20*** | (2006.01) |

(52) U.S. Cl.

CPC ..... *F42B 10/64* (2013.01); *F42B 10/14* (2013.01); *F42B 10/18* (2013.01); *F42B 10/20* (2013.01)

USPC ..... 244/3.28; 244/3.27; 244/3.24

(58) Field of Classification Search

USPC ..... 244/3.28, 3.27, 3.24, 49; 89/1.8

See application file for complete search history.

(56) References Cited

U.S. PATENT DOCUMENTS

| | | | | |
|---|---|---|---|---|
| 3,819,132 | A * | 6/1974 | Rusbach | 244/3.28 |
| 4,600,167 | A * | 7/1986 | Kastenhuber et al. | 244/3.28 |
| 5,114,095 | A * | 5/1992 | Schroppel et al. | 244/3.28 |
| 5,668,347 | A * | 9/1997 | Mikhail | 102/523 |
| 5,762,291 | A * | 6/1998 | Hollis et al. | 244/3.24 |
| 6,126,109 | A * | 10/2000 | Barson et al. | 244/3.28 |
| 6,454,205 | B2 * | 9/2002 | Niemeyer et al. | 244/3.26 |
| 6,880,780 | B1 * | 4/2005 | Perry et al. | 244/3.27 |
| 7,207,518 | B2 * | 4/2007 | Alculumbre et al. | 244/3.29 |
| 7,851,734 | B1 * | 12/2010 | Hash et al. | 244/3.27 |

(Continued)

FOREIGN PATENT DOCUMENTS

| | | |
|---|---|---|
| EP | 0158702 A2 | 10/1985 |
| EP | 0354088 A1 | 2/1990 |

(Continued)

*Primary Examiner* — Christopher P Ellis
*Assistant Examiner* — Medhat Badawi
(74) *Attorney, Agent, or Firm* — Baker & Hostetler LLP

(57) ABSTRACT

A steering section for guided munition comprises a steering body having n control surfaces folded inside or deployed protruding from the external surface. The steering section comprises a locking mechanism for the n control surfaces folded inside the steering body having a lock support secured thereto, a fixed sleeve secured to the lock support comprising a locking barrel, a mobile sleeve surrounding the fixed sleeve and slideable longitudinally along the locking barrel, the mobile sleeve comprising, on the outside of the fixed sleeve, a free end collaborating with the n control surfaces to keep them folded inside the steering body, a translational-locking device locking the translational movement along the mobile sleeve along the locking barrel deactivatable by unlocking force to trigger translational sliding movement of the mobile sleeve along the locking barrel and release the n control surfaces which can then move from their folded position into their deployed position.

18 Claims, 13 Drawing Sheets

(56) References Cited

U.S. PATENT DOCUMENTS

| | | | | |
|---|---|---|---|---|
| 8,324,544 | B2 * | 12/2012 | Palani et al. | 244/3.24 |
| 8,592,737 | B2 * | 11/2013 | Deschatre | 244/3.28 |
| 8,610,042 | B2 * | 12/2013 | Sankovic | 244/3.24 |
| 2010/0050712 | A1 * | 3/2010 | Tong et al. | 70/185 |
| 2012/0091255 | A1 * | 4/2012 | Sweer | 244/3.27 |
| 2012/0175460 | A1 * | 7/2012 | Palani et al. | 244/3.28 |

FOREIGN PATENT DOCUMENTS

| | | | |
|---|---|---|---|
| FR | 1187193 | A1 | 9/1959 |
| FR | 2530332 | A1 | 1/1984 |
| WO | 86/03579 | A1 | 6/1986 |

* cited by examiner

STEERING SECTION FOR GUIDED MUNITION

CROSS-REFERENCE TO RELATED APPLICATION

This application claims priority to foreign French patent application No. FR 1200246, filed on Jan. 27, 2012, the disclosure of which is incorporated by reference in its entirety.

FIELD OF THE INVENTION

The invention relates to guided munitions and missiles equipped with a steering section, such as guided artillery rounds and notably guided rockets.

BACKGROUND

Just like missiles, guided munitions may be fitted with a steering section comprising guide vanes commonly known as canard wings or control surfaces. As it flies towards a target, the guided munition is steered by control and guidance electronics of the munition that provides closed loop control of the position of the control surfaces using motorized drive of the electric, pneumatic or pyrotechnic type.

In general, guided munitions are fired from a launch tube such as a rocket launcher, a gun barrel or a mortar tube. There are at least two main phases in the launch of a guided munition: a firing phase which ejects it from the launch tube, followed by an external ballistic phase after it has left the launch tube in order to head towards a target.

The control and guidance section of the guided munition comprises a system for controlling the control surfaces which need to be contained within the launch tube during the firing phase. The control surfaces are in a retracted position inside the launch tube and then deploy during the external ballistic phase, namely after the munition has left the launch tube. In general, the control surfaces of the guided munition deploy in an umbrella fashion, opening either in the direction of launch of the munition against the aerodynamic wind produced by the speed of the munition or in the opposite direction to the direction of launch of the munition.

The system controlling the control surfaces firstly ensures that they are kept in the retracted position allowing the munition to be inserted into the launch tube and secondly ensures that they deploy following tube exit.

Deployment of the control surfaces can be achieved either using a mechanism that operates automatically as soon as the munition is ejected, namely as soon as the steering section has left the launch tube without the need for a specific deployment command sent from the control surface operating electronics, or by another mechanism that deploys the control surfaces only on receipt of one or more commands transmitted by the operating electronics to the system controlling the control surfaces at a desired moment in the trajectory phase or external ballistic phase of the munition. In order to be compatible with both types of operation, the control surfaces control system has to be able to be configured so that when the munition leaves the launch tube the electronics, on a single command sent by the operating electronics, authorizes simultaneously the unlocking of the control surfaces retention system and the deployment of those control surfaces. In another configuration of the control surfaces control system, a first command sent by the guidance/control electronics to the control surfaces control system will allow the control surfaces to be unlocked, and a second command after the first will allow them to be deployed.

The control surfaces control system also needs to have a response time compatible with the most rapidly moving munitions, to be able to withstand firing environments of the gunshot type, and be able to be incorporated into low-caliber munitions and be reversible so that control surfaces opening tests can be performed.

However, the steering sections of the prior art do not have enough compactness or robustness to be used on increasingly high-performing guided munitions.

SUMMARY OF THE INVENTION

The invention proposes a steering section for guided munition comprising a steering body having an external surface of cylindrical shape about a longitudinal axis XX', n control surfaces G1, G2, . . . Gi, . . . Gn around the longitudinal axis XX' which can adopt either a folded position folded inside the steering body or deployed position protruding from the external surface of the steering body, n being a whole number greater than 1, in order to guide the munition, said section comprising a locking mechanism for locking the n control surfaces in the folded position inside the steering body, the said locking mechanism having

- a lock support in the form of a tube secured at one end to the steering body, of axis of revolution AA' coincident with the longitudinal axis XX', closed, at its end nearest the n control surfaces, by a lock wall comprising, along the axis AA', a lock opening of diameter D2 less than the diameter D1 of the cylindrical internal surface of the lock support so as to form, inside the lock support, an annulus-shaped bearing surface,
- a fixed sleeve of cylindrical shape of axis of revolution AA' coinciding with the longitudinal axis XX' and comprising a fixing annulus in a plane perpendicular to the axis AA' secured to the lock support by the opposite end to the lock wall, a locking barrel in the form of a tube of circular cross section with outside diameter D3 passing through the lock opening and having a free edge outside the lock support,
- a mobile sleeve in the form of a tube of circular cross section of external diameter D4 surrounding the fixed sleeve and able to slide longitudinally along the axis AA' via its internal surface on the external surface of the locking barrel, the mobile sleeve comprising, at the same end of the lock opening on the outside of the fixed sleeve, a free end collaborating with the n control surfaces G1, G2, . . . Gi, . . . Gn in order to keep them in their folded position inside the steering body and another end, the opposite end to the free end inside the lock support comprising a flange of diameter D5 greater than the external diameter D4 of the mobile sleeve,
- a translational-locking device for locking the translational movement along the axis AA' of the mobile sleeve on the locking barrel, which can be deactivated by an unlocking force F to trigger a sliding translational movement of the mobile sleeve on the locking barrel and the release of the n control surfaces which can then move from their folded position into their deployed position,
- an unlocking helical spring around the mobile sleeve to cause the mobile sleeve to slide on the fixed sleeve when the locking device is deactivated.

In one embodiment of the steering section, the locking barrel comprises, in a central part between its two ends, an internal wall in a plane perpendicular to the axis AA' having a circular passage of axis coincident with the axis AA' so as to form, between the free end of the locking barrel a cavity of circular cross section comprising a mobile part of the locking device.

In another embodiment, the mobile part of the locking device comprises, between the free edge and the internal wall of the locking barrel, a return spring, compressed by a locking piston having a first piston surface of diameter D6 that can slide in the cavity of the locking barrel, the first piston surface being connected by an intermediate surface of frustoconical shape to a second piston surface of diameter D7 smaller than the diameter D6 of the first surface of the locking piston.

In another embodiment, the translational-locking device comprises blocking holes in the circular wall of the locking barrel and evenly distributed about the axis AA' in a plane perpendicular to the said axis AA', blocking balls, inserted in the blocking holes of diameter greater than the thickness of the circular wall of the locking barrel, a groove on the side of the internal surface of the mobile sleeve, when the locking mechanism is in a position known as the locked position, the blocking balls inserted in the blocking holes of the circular wall of the locking barrel in contact with the first piston surface of diameter D6 are inserted partially into the groove of the mobile sleeve blocking the mobile sleeve against translational movement along the fixed sleeve.

In another embodiment, when the locking mechanism is in what is known as the locked position, the helical spring is compressed between the flange of the mobile sleeve and the lock wall of the lock support, the helical spring, on relaxing upon deactivation of the locking device, bringing the free end of the mobile sleeve closer to the fixed sleeve.

In another embodiment, when the locking mechanism is in what is known as the locked position, the helical spring is compressed between the flange of the mobile sleeve and the fixing annulus of the fixed sleeve, the helical spring, as it relaxes upon deactivation of the locking device, moving the free end of the mobile sleeve further away from the fixed sleeve.

In another embodiment, the mobile part locking piston comprises, at the same end of the circular passage of the internal wall of the locking barrel, an application surface on which the unlocking force F acts in order to compress the return spring and, during a first phase of unlocking of the locking mechanism, applies the second surface of diameter D7 of the locking piston facing the blocking balls which, on withdrawing from the groove of the internal surface of the mobile sleeve allow the mobile sleeve a translational movement along the locking barrel through the relaxation of the unlocking helical spring, in a last unlocking phase, releasing the n control surfaces and allowing them to pass from the folded position into the deployed position.

In another embodiment, the locking barrel comprises another cavity between the internal wall of the locking barrel and the fixing annulus secured to the lock support, the other cavity opening via the fixing annulus containing a device for generating the unlocking force F which is secured to the steering section body.

In another embodiment, the device for generating the unlocking force F is a pyrotechnic device.

In another embodiment, the pyrotechnic device comprises a pyrotechnic tube of circular cross section able to slide in the other cavity, the pyrotechnic tube being closed, at the same end as the internal wall of the locking barrel, by a pyrotechnic tube wall comprising a circular opening of diameter D9, and at the other end of the pyrotechnic tube by another closure wall of circular cross section of diameter D10 greater than the diameter D8 of the pyrotechnic tube.

In another embodiment, the other closure wall of the pyrotechnic device is extended by a cylindrical body of diameter D12 less than the diameter of the other closure wall in order to create an annulus-shaped bearing surface for a clamping ring, threaded on its periphery, comprising a passage on its axis of revolution for the passage, through the said clamping ring, of the cylindrical body of the pyrotechnic device.

In another embodiment, the pyrotechnic tube comprises, between the pyrotechnic tube wall comprising the circular opening and the other closure wall, a pyrotechnic piston able to slide in a fluidtight manner inside the pyrotechnic tube, the pyrotechnic piston reducing in diameter so as to pass through the circular opening in the wall of the pyrotechnic tube, an igniter and a pyrotechnic charge forming, with the pyrotechnic piston, a pyrotechnic chamber, an O-ring seal surrounding the pyrotechnic piston ensuring that the pyrotechnic chamber is fluidtight.

In another embodiment, the pyrotechnic piston is in contact, via the application surface on which the unlocking force F acts, with the locking piston in the locking barrel of the fixed sleeve such that the said locking piston in the cavity is not in direct contact with the internal wall of the locking barrel, pressure of direct contact between the locking piston in the cavity and the pyrotechnic piston of the pyrotechnic device being applied by the return spring compressed between the closure ring secured to the free end of the locking barrel and the locking piston in the cavity.

In another embodiment, the force-generating device that generates the unlocking force F is an electromagnetic device such as an electromagnet.

In another embodiment, the force-generating device that generates the unlocking force F is a pneumatic device.

The invention also relates to a tool for resetting the locking of the locking mechanism of the steering section when the helical spring between the flange of the mobile sleeve and the lock wall of the lock support is relaxed and the flange of the mobile sleeve is in abutment against an internal shoulder of the fixing annulus of the fixed sleeve, the locking mechanism comprising a series of holes of axes parallel to the axis XX' passing through the fixing annulus of the fixed sleeve and distributed evenly about the axis AA' and opening in the region of the flange of the mobile sleeve, characterized in that it comprises a handle having cylindrical rods secured to the handle and distributed on the said handle in such a way that a rod enters a respective hole of the fixing annulus, pressure applied to the handle and transmitted via the rods to the flange compressing the locking helical spring in order to reset the locking device.

The invention also relates to a tool for resetting the locking of the locking mechanism of the steering section when the helical spring is compressed between the flange of the mobile sleeve and the fixing annulus of the fixed sleeve, the flange of the mobile sleeve comprising a series of threaded holes with axes parallel to the axis XX' and distributed evenly about the axis AA', characterized in that it comprises a handle having cylindrical rods secured by one of their ends to the said handle, the other, free, ends of the rods being threaded so that they can be screwed into the threaded holes of the flange of the mobile sleeve and secured to the handle, a pulling force being applied to the handle in order, during the setting, to bring the mobile sleeve back towards the fixing annulus, thereby compressing the helical spring in order to reset the locking device.

The steering section according to the invention advantageously meets the requirements by having a mechanism which is robust and compact and provided with an interchangeable pyrotechnic device.

The novel steering section according to the invention improves robustness and compactness in relation to the steering devices of the prior art.

BRIEF DESCRIPTION OF THE DRAWINGS

The invention will be better understood with the aid of some exemplary embodiments of guided munition steering sections given with reference to the annexed figures in which.

DETAILED DESCRIPTION

Figure 1A:
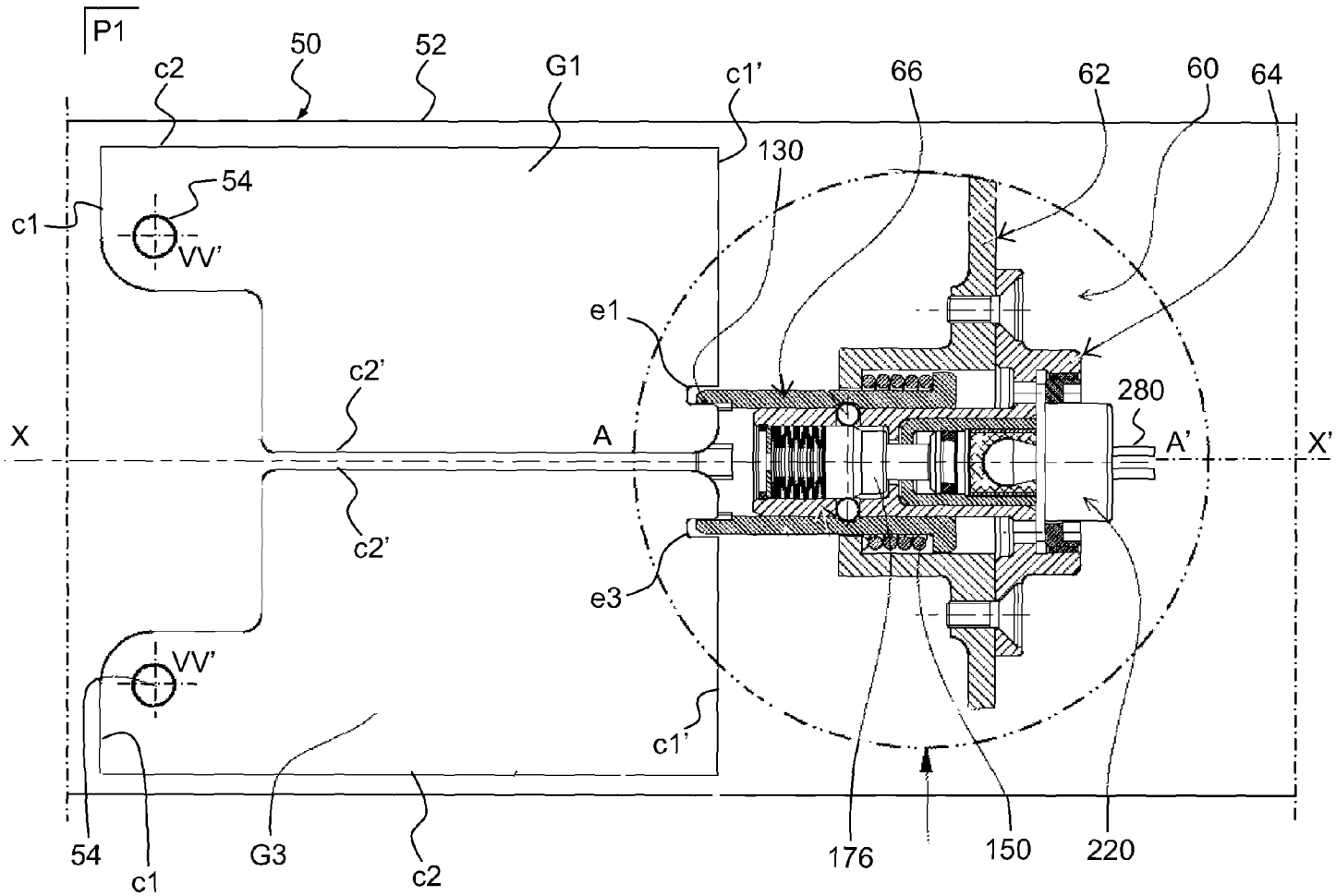
FIG. 1*a* depicts a partial view of a steering section of a guided munition comprising a control surfaces locking mechanism according to the invention.

FIG. 1*a* depicts a partial view of a steering section of a guided munition comprising a mechanism for locking the control surfaces, according to the invention.

Figure 1B:
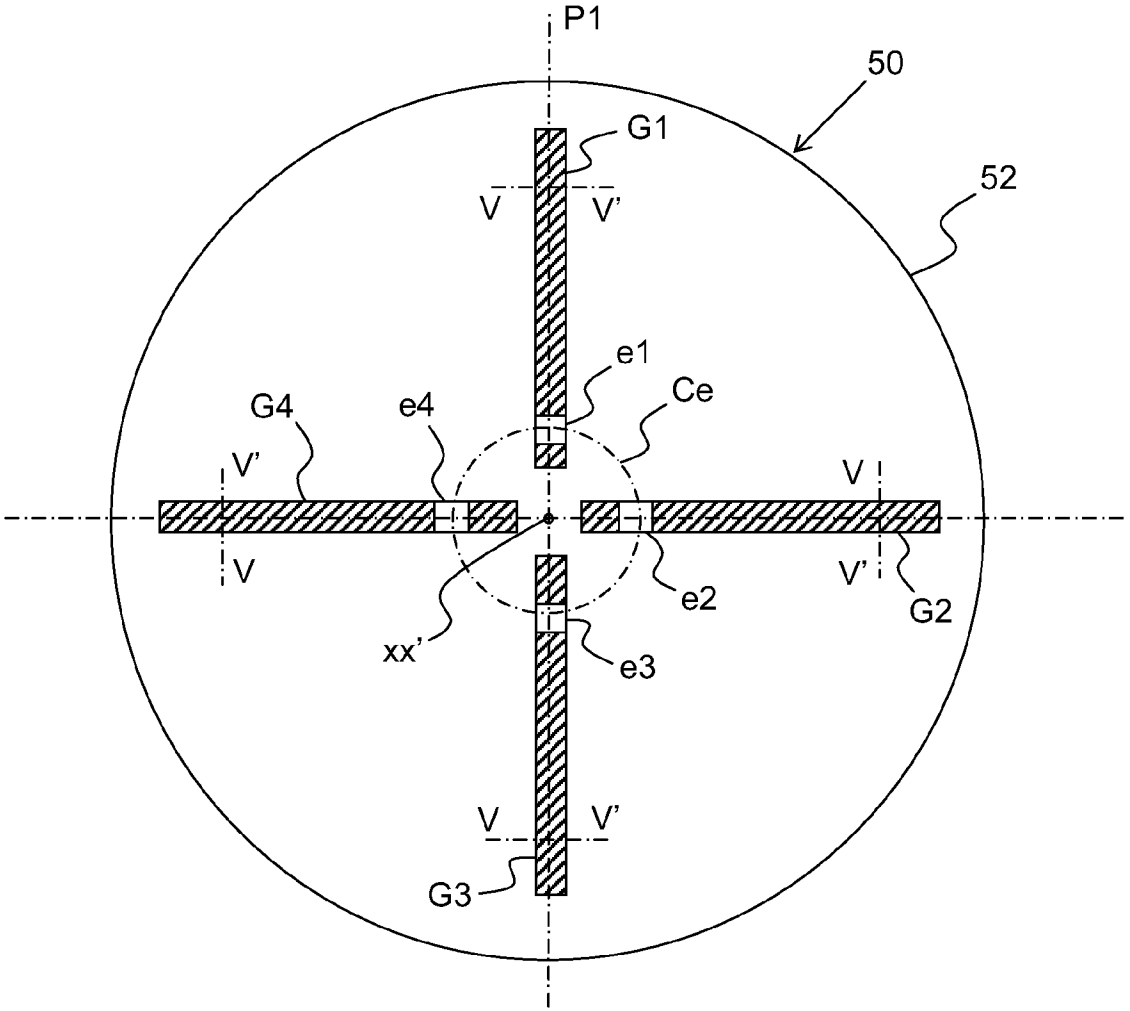
FIG. 1*b* depicts a partial face-on view of the steering section of FIG. 1*a;*

FIG. 1*b* a partial face-on view of the steering section of FIG. 1*a*.

The steering section of FIG. 1*a* comprises a steering body 50 having an external surface 52 of circular cylindrical shape about a longitudinal axis XX', four control surfaces G1, G2, G3, G4 (i.e. n=4) distributed evenly about the longitudinal axis XX' and which can either adopt a folded position folded inside the steering body or a deployed position protruding beyond the external surface 52 of the steering body 50 in order to guide the munition during its external ballistic phase. A locking mechanism 60 keeps the four control surfaces in the folded position inside the steering body 50 during the firing phase. Deactivation of the locking mechanism 60 releases the four control surfaces which can then be brought into their deployed position.

The four control surfaces, in this embodiment of FIG. 1*a*, have the same rectangular shape with opposite short sides c1, c1' and opposite long sides c2, c2'. When the control surfaces are in the folded position, at least long sides c2,c2' are parallel to the axis XX'.

The four control surfaces can pivot, on the side of one of their short sides c1 furthest from the locking mechanism 60, about a respective rotation shaft 54 of axis W' perpendicular to a plane passing through the longitudinal axis XX'. FIG. 1*a* shows the two control surfaces G1, G3 in a plane P1 passing through the longitudinal axis XX'.

The opposite short sides c1,c1' of the four control surfaces G1, G2, G3, G4 comprise, as depicted in FIG. 1*b*, on the same side as the locking mechanism 60, respective notches e1, e2, e3, e4 distributed about a circle Ce of notches the centre of which lies on the longitudinal axis XX' so that the locking mechanism 60 can lock the four control surfaces in the folded position folded inside the steering body.

Figure 2:
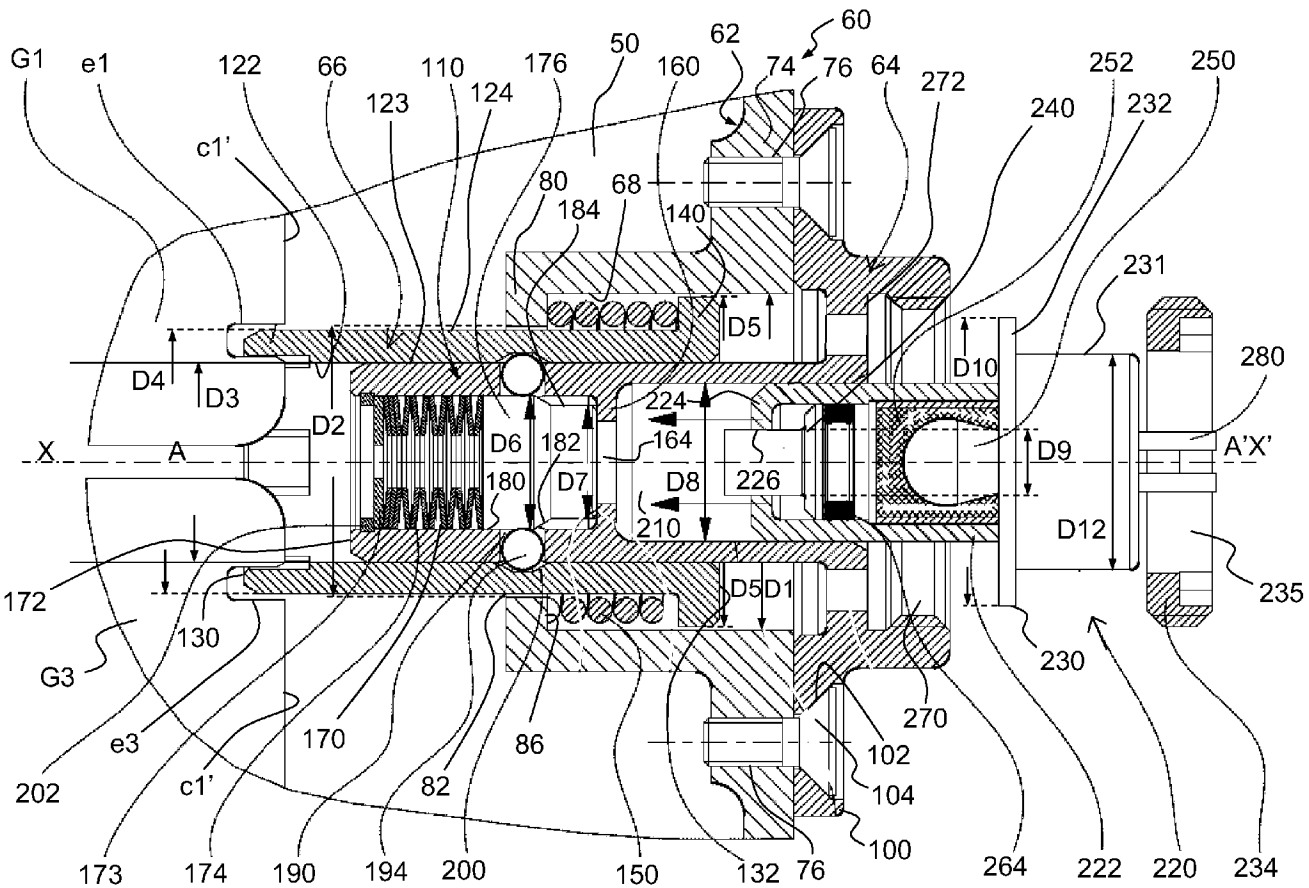
FIG. 2 shows a detailed view of the control surfaces locking mechanism of the steering section of FIG. 1*a* comprising a pyrotechnic device.

FIG. 2 shows a detailed view of the locking mechanism that locks the control surfaces of the steering section of FIG. 1*a* comprising a pyrotechnic device.

The locking mechanism 60 comprises a lock support 62 in the form of a tube of circular section secured to the steering body 50, with axis of revolution AA' coinciding with the longitudinal axis XX', a fixed sleeve 64 secured to the lock support 62 and also of cylindrical shape with axis of revolution AA' coinciding with the longitudinal axis XX', a mobile sleeve 66 able to slide on the fixed sleeve, a translational-locking device keeping the mobile sleeve in a longitudinal position on the fixed sleeve, an unlocking helical spring 150 around the mobile sleeve 66 to cause the mobile sleeve to slide on the fixed sleeve upon deactivation of the locking device.

The lock support 62 comprises a circular cylindrical internal support surface 68 of diameter D1. The lock support 62 widens in diameter, at its end furthest from the control surfaces, into the form of a lock support annulus 74 comprising threaded holes 76 evenly distributed about the axis AA'. The lock support 62 is closed at its other end by a lock wall 80 comprising, along the axis AA', a circular lock opening 82 of diameter D2 less than diameter D1.

The lock wall 80 forms, on the same side as the internal support surface 68 of the lock support 62, a bearing surface 86 in the shape of an annulus in a plane perpendicular to the axis AA'.

The fixed sleeve 64 comprises two opposite ends along the axis AA'. One of the ends of the fixed sleeve comprises a fixing annulus 100 for fixing to the lock support annulus 74 in a plane perpendicular to the axis AA' and having fixing holes 102 facing the threaded holes 76 of the lock support annulus 74 for the passage of fixing screws 104 fixing the fixed sleeve 64 to the lock support 62.

The fixed sleeve 64 is extended, inside the lock support 62, by a locking barrel 110 in the form of a tube passing through the circular lock opening 82 of the lock support 62, with an axis of revolution coinciding with the axis AA', of circular cross section and of outside diameter D3.

The four control surfaces are locked by the mobile sleeve 66 of the locking mechanism 60. The mobile sleeve 66 is in the form of a tube of circular cross section of external diameter D4 surrounding the locking barrel 110 and able to slide longitudinally along the axis AA', via its internal surface 122 on the external surface 123 of the locking barrel 110 and via its external surface 124 of diameter D4 in the lock opening 82 of the lock wall 80 of the lock support 62.

The mobile sleeve 66 comprises, on the same side as the lock opening 82 on the outside of the fixed sleeve 64, a free end 130 which is inserted into the notches e1, e2, e3, e4 of the four control surfaces in order to keep them in their folded position folded inside the steering body 50, and another end 132, the opposite end to the free end 130 of the mobile sleeve inside the lock support 62 comprising a flange 140 of diameter D5 greater than the diameter D4 of the external surface 124 of the mobile sleeve 66, the said flange 140 facing the bearing surface 86 of the lock support 62 and being able to slide on the internal support surface 68 of the lock support 62.

The control surfaces locking mechanism 60 is deactivated by an unlocking force F acting on the translational-locking device that locks the mobile sleeve 66 in order to allow it a sliding translational movement along the locking barrel 110 and allow the unlocking of the four control surfaces which can then move from their folded position into their deployed position. For that purpose, when the mechanism is in the locked position, the unlocking helical spring 150 is compressed between the annulus-shaped bearing surface 86 and the flange 140 facing the lock wall 80 of the lock support 62. Decompression of the helical spring releases the free end 130 of the mobile sleeve 66 from the notches e1, e2, e3, e4, freeing the four control surfaces.

The locking barrel 110 comprises, in a central part between its two ends, an internal wall 160 in a plane perpendicular to the axis AA' and having a circular passage 164 with axis of revolution coinciding with the axis AA' so as to form, between the end of the locking barrel 110 at the same end as the free end 130 of the mobile sleeve 66, and the said internal wall 164, a cavity 170 of circular cross section containing a mobile part of the translational-locking device intended to be actuated by the unlocking force F.

The said mobile part in the cavity 170 comprises, at the same end as the free edge 172 of the locking barrel closed by a closure ring 202 secured to the said free edge 172, a thrust washer 173 and a return spring 174 compressed by a locking piston 176 onto the closure ring 202. The locking piston 176 comprises a first circular cylindrical surface 180 of diameter D6 able to slide inside the locking barrel 110, the first surface 180 being connected by an intermediate surface 182 of frustoconical shape to a second surface 184 of diameter D7 smaller than the diameter D6 of the first external surface 180 of the locking piston.

The translational-locking device comprises locking holes 190 in the circular wall of the locking barrel 110 evenly distributed about the axis AA' and, in a plane perpendicular to the said axis AA', blocking balls 194 inserted in the blocking holes 190, the balls being of a diameter greater than the thickness of the circular wall of the locking barrel 110 so that they protrude slightly beyond the external surface of the locking barrel 110 in order to become lodged in a groove 200 of circular cross section formed in the wall of the mobile sleeve 66.

When the locking mechanism is in a position known as the locked position, blocking the translational movement of the mobile sleeve 66 on the locking barrel 110, the blocking balls 194, in the blocking holes 190 of the circular wall of the locking barrel 110, in contact with the first circular surface 180 of diameter D6 of the locking piston 176, are inserted, via that part of the balls that protrudes beyond the blocking holes 190, into the groove 200 of the mobile sleeve 66, the return spring 174 then being partially compressed between the closure ring 202 secured to the free edge 172 of the fixed sleeve and the locking piston 176.

The cavity 170 of the fixed sleeve 110 opens through the circular passage 164 onto another cavity 210 of circular cylindrical shape of diameter D8 with axis of revolution coinciding with the axis AA' opening via the fixing annulus 100 of the fixed sleeve 64. This other cavity 210, in this embodiment, contains a pyrotechnic device 220 intended to generate the unlocking force F on the locking piston 176 of the locking mechanism.

The pyrotechnic device 220 comprises a pyrotechnic tube 222 of circular cross section able to slide into the other cavity 210. The pyrotechnic tube is closed, on the same side as the internal wall 160 of the locking barrel 110, by a pyrotechnic tube wall 224 comprising a circular opening 226 of diameter D9 and, at the other end of the pyrotechnic tube 222, via another closure wall 230 of circular cross section of diameter D10 greater than the diameter D8 of the pyrotechnic tube. The other closure wall 230 is extended by a cylindrical body 231 of diameter D12 less than the diameter of the other closure wall 230 in order to create an annulus-shaped bearing surface 232 for a clamping ring 234. The clamping ring 234 is threaded at its periphery and has a passage 235 along its axis for the passage of the cylindrical body 231 of the pyrotechnic device 220.

The pyrotechnic tube 222 comprises, between the pyrotechnic tube wall 224 comprising the circular opening 226, and the other closure wall 230, a pyrotechnic piston 240 able to slide in fluidtight manner in the pyrotechnic tube 222, the pyrotechnic piston 240 reducing in diameter in order to pass through the circular opening 226 in the pyrotechnic tube wall, an igniter 250 and a pyrotechnic charge 252 forming, together with the pyrotechnic piston 240, a pyrotechnic chamber 260.

An O-ring seal 264 surrounding the pyrotechnic piston 240 makes the pyrotechnic chamber 260 fluidtight.

The other cavity 210 of circular cylindrical shape with diameter D8 opens via the fixing annulus 100 of the fixed sleeve 64 via a threaded annulus recess 270 of circular cross section with a diameter greater than the diameter of the closure wall 230 of the pyrotechnic tube, thus creating an annulus shoulder 272.

When the pyrotechnic device is inserted into the other cavity 210, the closure wall 230 of the pyrotechnic tube comes into abutment against the annulus shoulder 272. Screwing of the threaded clamping ring 234 onto the internal screw thread of the annulus recess 270 blocks the pyrotechnic device in the other cavity 210 of the locking barrel 110.

Figure 3:
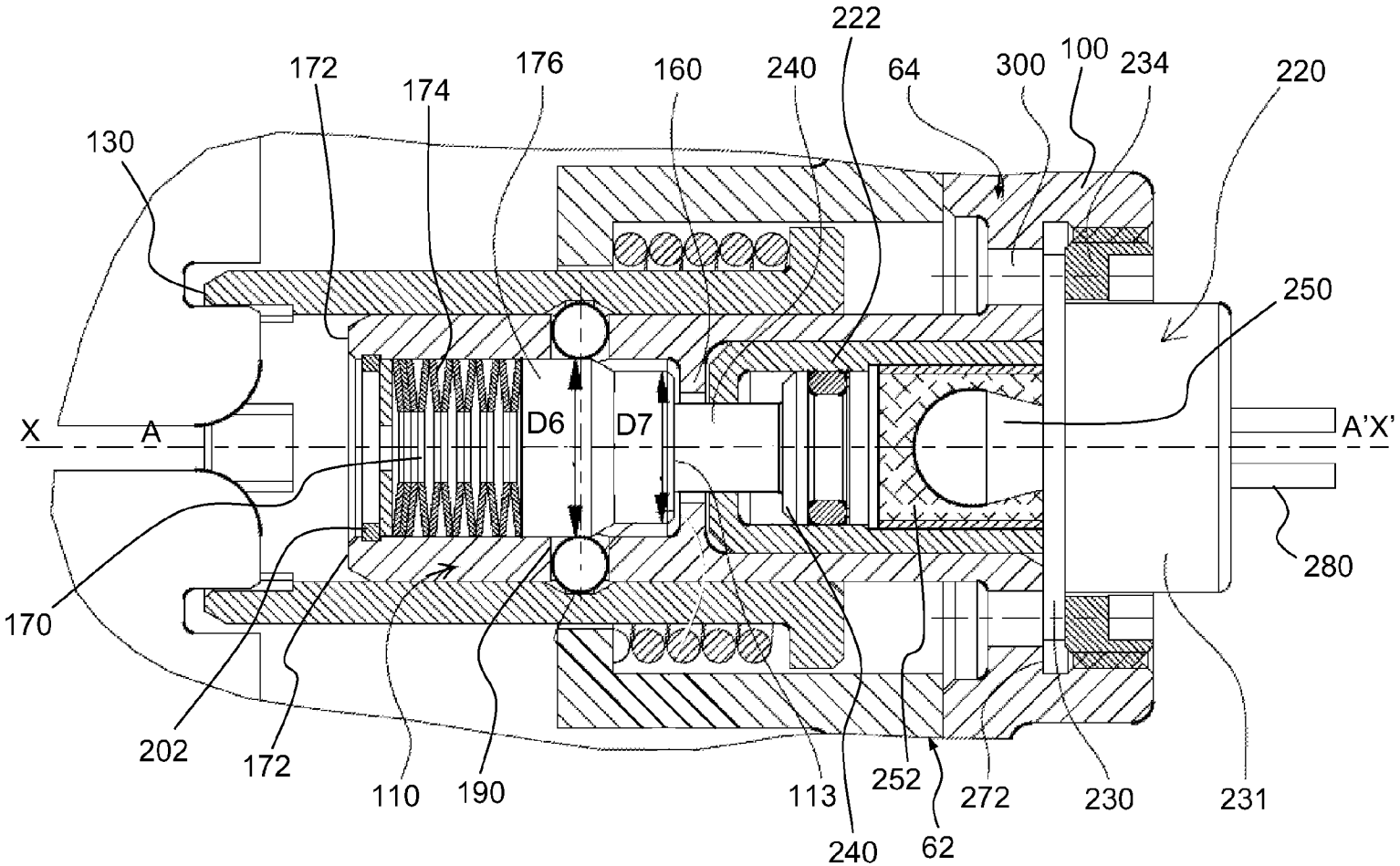
FIG. 3 shows the locking mechanism of FIG. 2 in the locked position.

FIG. 3 shows the locking mechanism of FIG. 2 in the locked position.

FIG. 3 shows the pyrotechnic device 220 locked in the other cavity 210 of the locking barrel 110 of the locking mechanism by the clamping ring 234 screwed into the threaded recess in the fixing annulus 100.

Electrical contacts 280 passing through the cylindrical body 231 electrically activate the igniter 250 of the pyrotechnic device via an external device that triggers the unlocking (and has not been depicted in the figures).

The external device may also, when the control surfaces have been released, bring about the deployment thereof at a chosen moment in the flight of the guided munition. Deployment of the four control surfaces may also occur automatically as soon as they are released.

Electrical activation of the igniter 250 and then of the pyrotechnic charge 252, because of the pressure of the gases released in the pyrotechnic chamber 260, cause the pyrotechnic piston 240 to move towards the outside of the pyrotechnic chamber and cause the said pyrotechnic piston to generate an unlocking force F on the application surface 113 on which the unlocking force of the locking piston 176 acts.

Operation of the locking mechanism 60 of the steering section according to the invention is described hereinafter with reference to FIGS. 3, 4, 5, 6 and 7.

The locking mechanism, shown in FIG. 3, is in the position of locking the four control surfaces G1, G2, G3, G4 in their folded position, folded inside the steering body 50. The pyrotechnic device 220 is inserted into and held in position in the other cavity 210 of the locking barrel 110 by the clamping ring 234 screwed into the threaded recess 270 of the fixing annulus 100. In this locked configuration, the pyrotechnic piston 240 is in direct contact with the locking piston 176 in the locking barrel 110 of the fixed sleeve 64 so that the said locking piston 176 in the cavity 170 is not in direct contact with the internal wall 160 of the locking barrel 110, direct pressure of contact between the locking piston 176 in the cavity 170 and the pyrotechnic piston 270 of the pyrotechnic device being applied by the return spring 174 compressed between the closure ring 202 secured to the free end 172 of the locking barrel and the locking piston 176 in the cavity 170.

Figure 4:
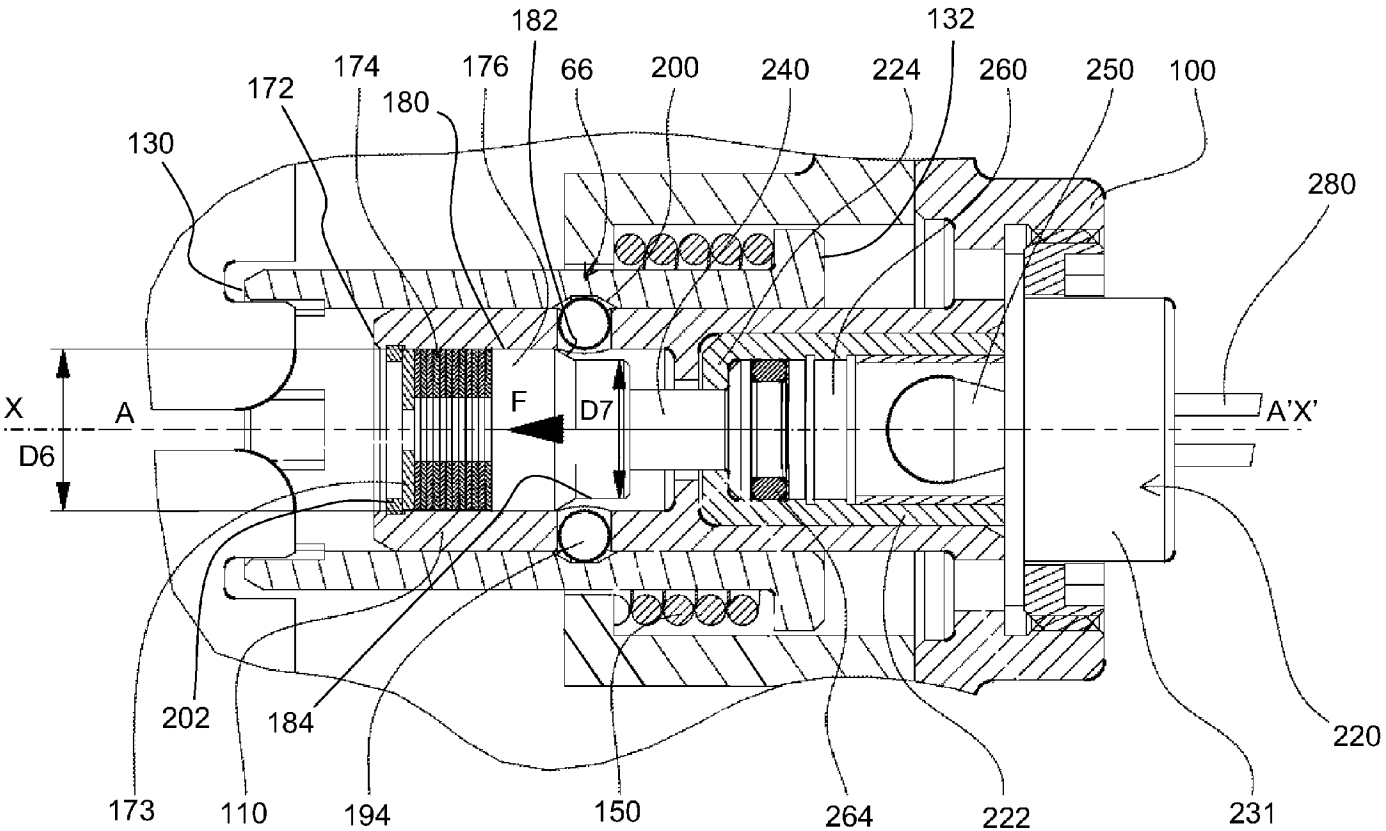
FIG. 4 shows the locking mechanism of FIG. 2 in a first phase of unlocking.

FIG. 4 shows the locking mechanism of FIG. 2 in a first phase of unlocking.

Activation of the igniter 250 and of the pyrotechnic charge 252 produces a gas pressure in the pyrotechnic chamber 260 and an unlocking force F applied by the pyrotechnic piston 240 to the locking piston 176 which moves towards the free edge 172 of the locking barrel 110 thereby compressing the return spring 174. In this first phase of unlocking, the second surface 184 of the locking piston 176 which has been moved by the thrust of the pyrotechnic piston 240, faces the blocking balls 194.

Figure 5:
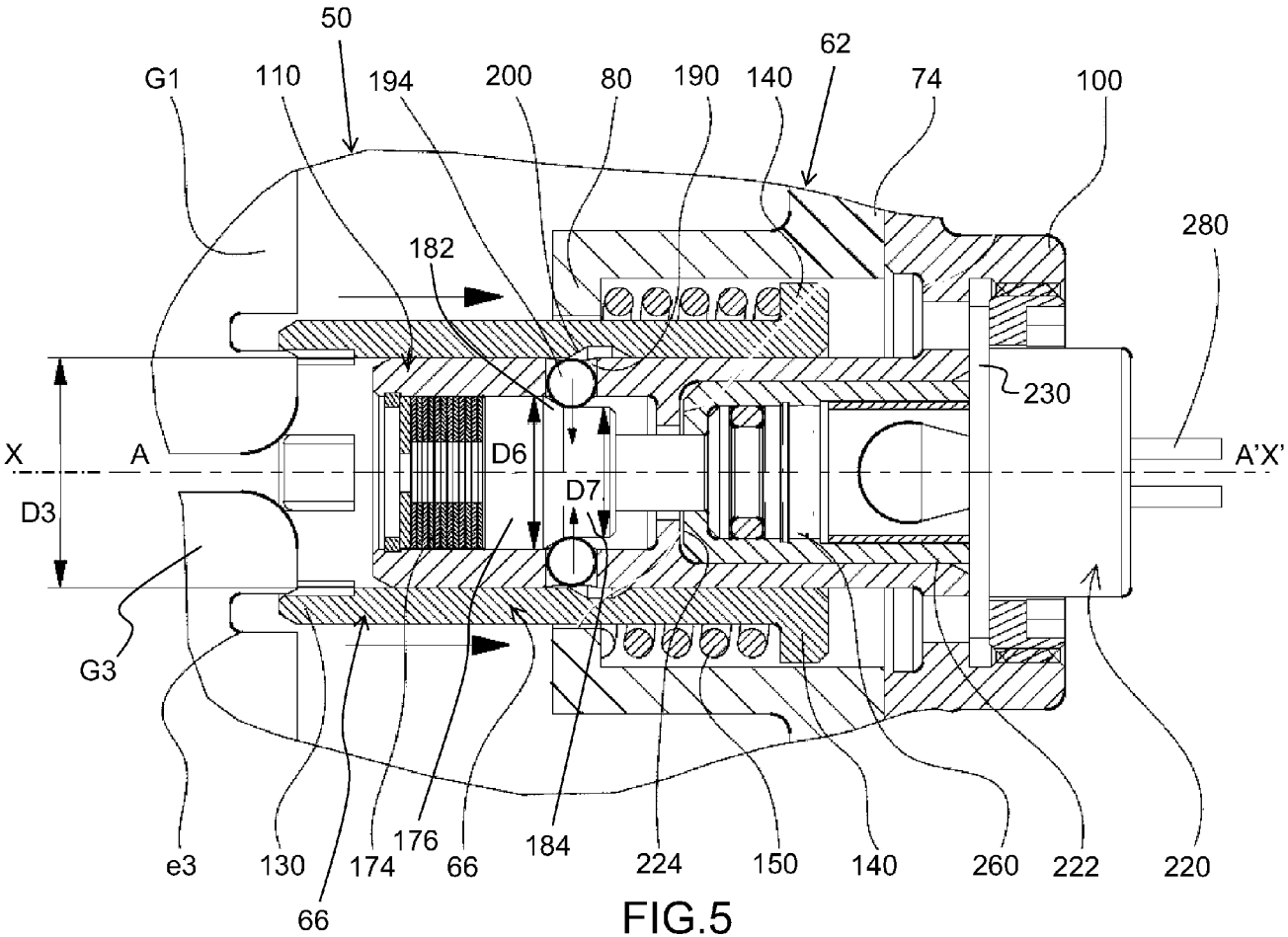
FIG. 5 shows the locking mechanism of FIG. 2 in a second phase of unlocking.

FIG. 5 shows the locking mechanism of FIG. 2 in a second phase of unlocking.

The blocking balls 194 guided by the blocking holes 190 may, in this second phase, position themselves on the second surface 184 of the locking piston 176 of smaller diameter D7, thereby releasing the groove 200 of the mobile sleeve which therefore becomes free. The helical spring 150, by relaxing, moves the mobile sleeve 66 towards the inside of the lock support 62.

Figure 6:
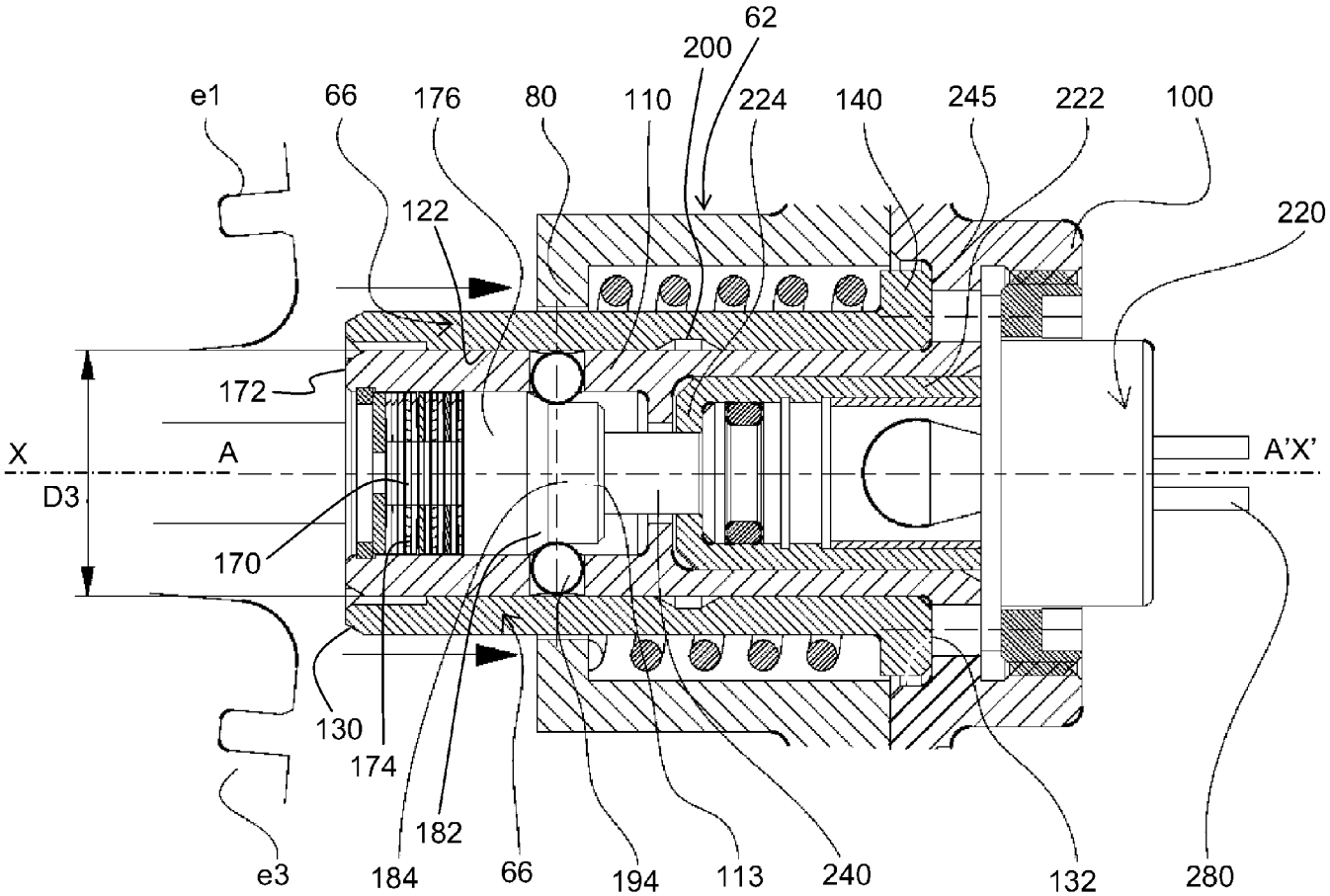
FIG. 6 shows the last phase of unlocking of the locking mechanism of FIG. 2.

FIG. 6 shows the final phase of unlocking of the locking mechanism of FIG. 2.

The movement of the mobile sleeve 66 continues towards the inside of the lock support 62 until via its flange 140 it comes into abutment against an internal shoulder 245 of the fixing annulus 100 inside the lock support 62 as depicted in FIG. 6. In this last phase, the free end 130 of the mobile sleeve 66 is disengaged from the notches e1, e2, e3, e4 of the four control surfaces which therefore find themselves free to rotate about their axle 54.

The return spring 174 is compressed by the locking piston 176 itself thrust by the pyrotechnic piston 240 in the locking barrel 110. In this last phase, the locking piston 176 is blocked against movement in the cavity 170 by the blocking balls 194 held between the internal surface 122 of the mobile sleeve 66 and the intermediate frustoconical surfaces 182 and second surface 184 of diameter D7 of the locking piston 176.

The control surfaces now released can rotate about their shaft 54 to gain the deployed position.

Figure 7:
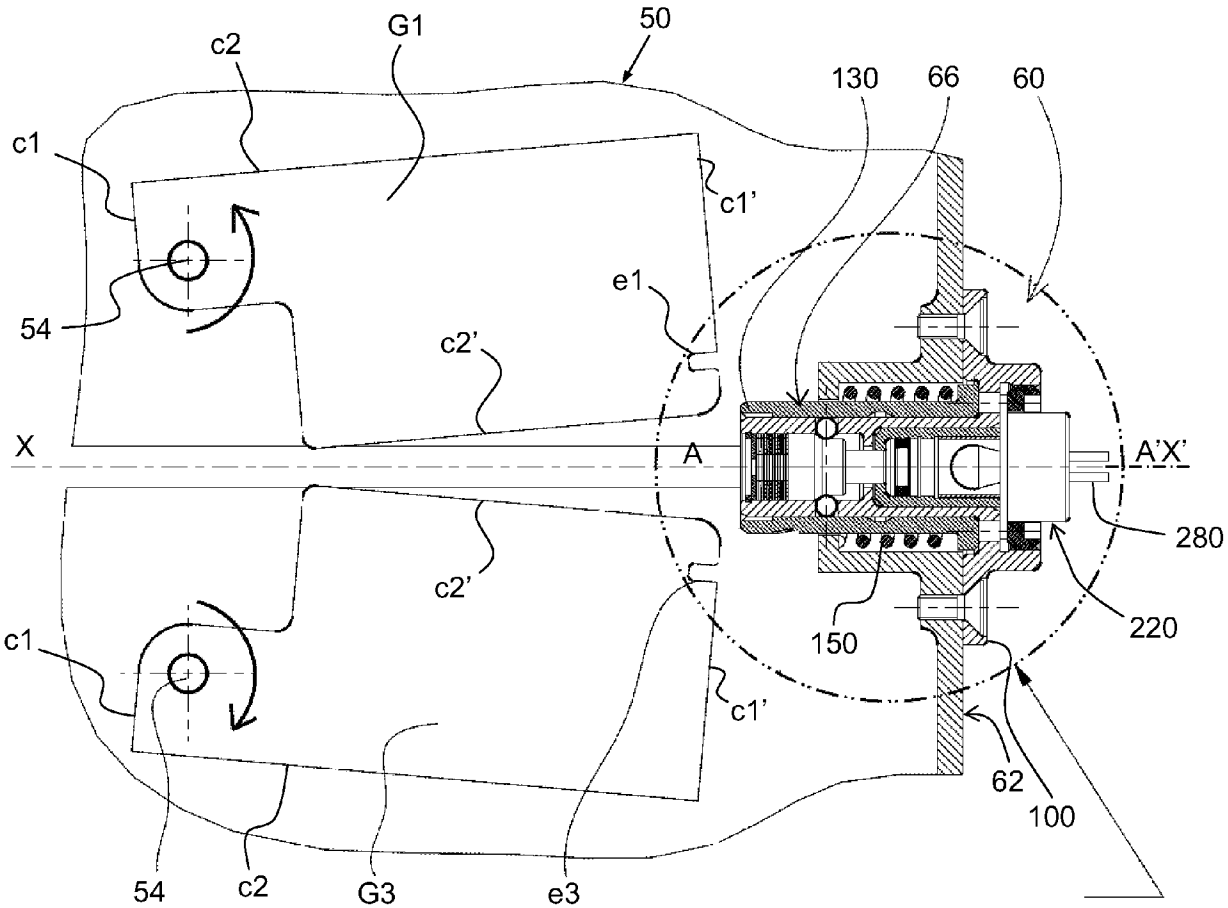
FIG. 7 shows the locking device of FIG. 2 in the unlocked position and the control surfaces in the process of deploying.

FIG. 7 shows the locking device of FIG. 2 in the unlocked position and the control surfaces in the process of deployment.

Operating electronics for the steering section system not depicted in the figures initiate the igniter of the interchangeable pyrotechnic device via its two power supply pins 280.

Figure 8:
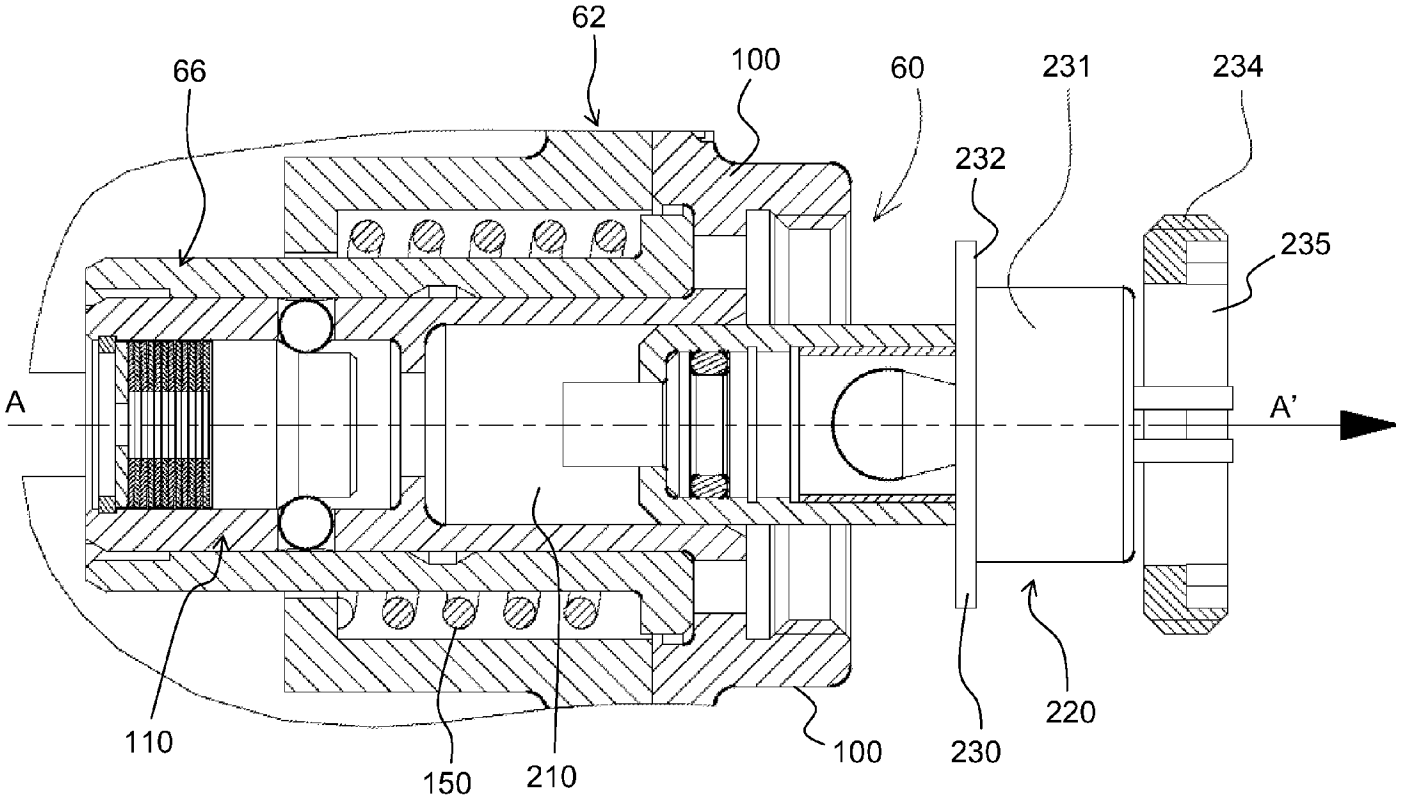
FIG. 8 shows the removal of the pyrotechnic device from the locking mechanism of FIG. 2.

FIG. 8 shows the removal of the pyrotechnic device from the locking mechanism of FIG. 2.

The pyrotechnic device is interchangeable and therefore independent of the locking system, and this allows it to be removed or replaced at any time. Once it has been used to trigger the locking mechanism, all that is required is for the clamping ring 234 to be unscrewed from the fixing annulus 100 and the used pyrotechnic device can be extracted from the other cavity 210 of the locking barrel 110 and potentially replaced with a new one.

The invention also relates to a device for resetting the locking of the locking mechanism of the steering section according to the invention.

Figure 9:
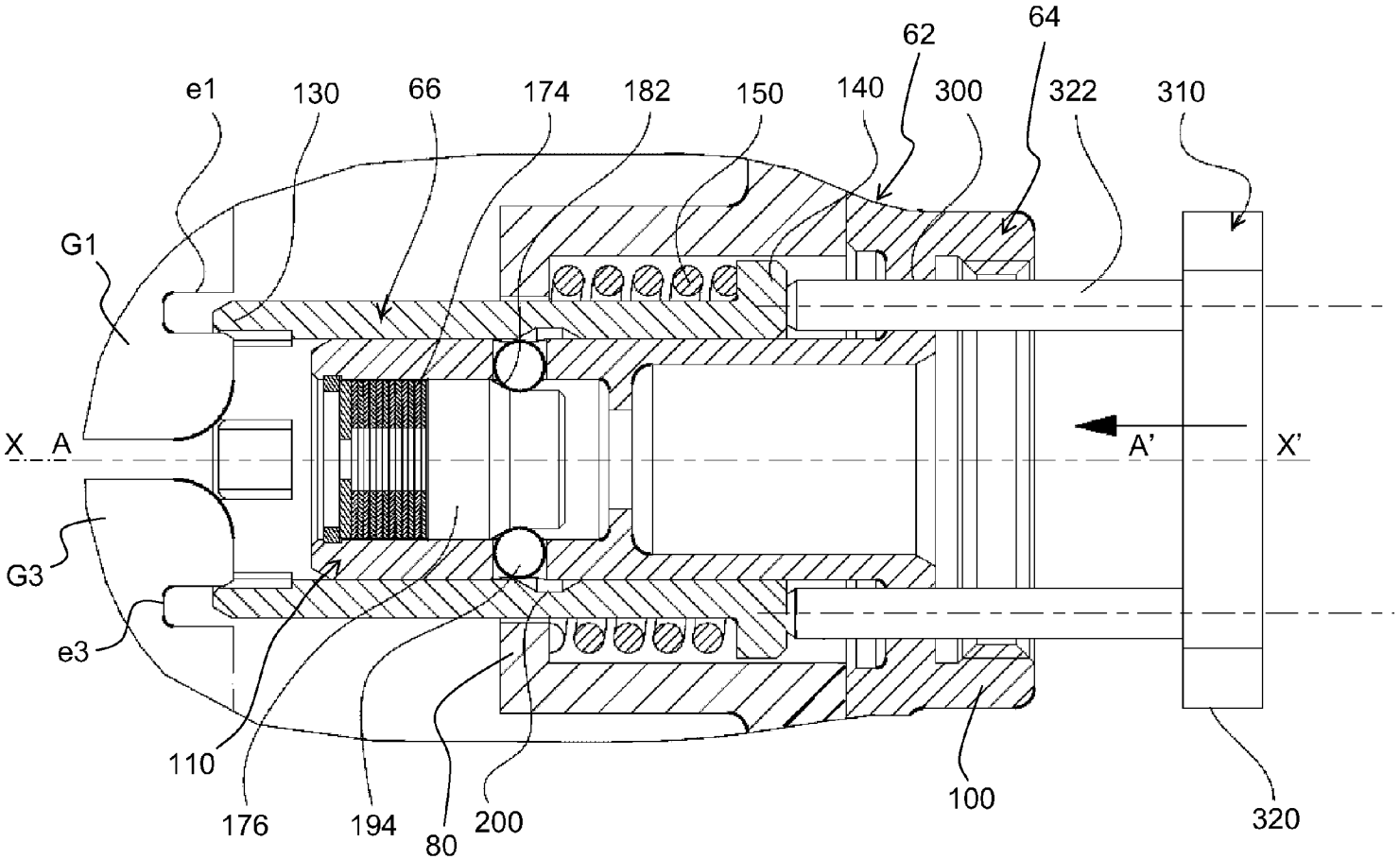
FIG. 9 shows a device for resetting the locking mechanism of the steering section of FIG. 2.

FIG. 9 shows a device for resetting the locking mechanism of the steering section of FIG. 2.

In order to make it resettable or re-lockable, the locking mechanism comprises a series of holes 300 with axes parallel to the axis XX' passing through the fixing annulus 100 of the fixed sleeve 64 and evenly distributed about the axis AA' and opening in the region of the flange 140 of the mobile sleeve 66, and a resetting tool 310.

The resetting tool 310 essentially comprises a handle 320 having cylindrical rods 322 secured to the handle 320 and distributed about the handle in such a way that one rod can enter one of the holes facing it in the fixing ring 100.

The control surfaces are returned to or placed in the folded position.

FIG. 9 shows a first phase in the resetting of the locking mechanism of FIG. 2. The rods 322 entering the holes 300 in the fixing annulus of the fixed sleeve bear against the flange 140 of the mobile sleeve 66, thereby compressing the helical spring 150 around the mobile sleeve 66 and causing the mobile sleeve 66 to slide along the locking barrel 110 of the fixed sleeve 64.

Figure 10:
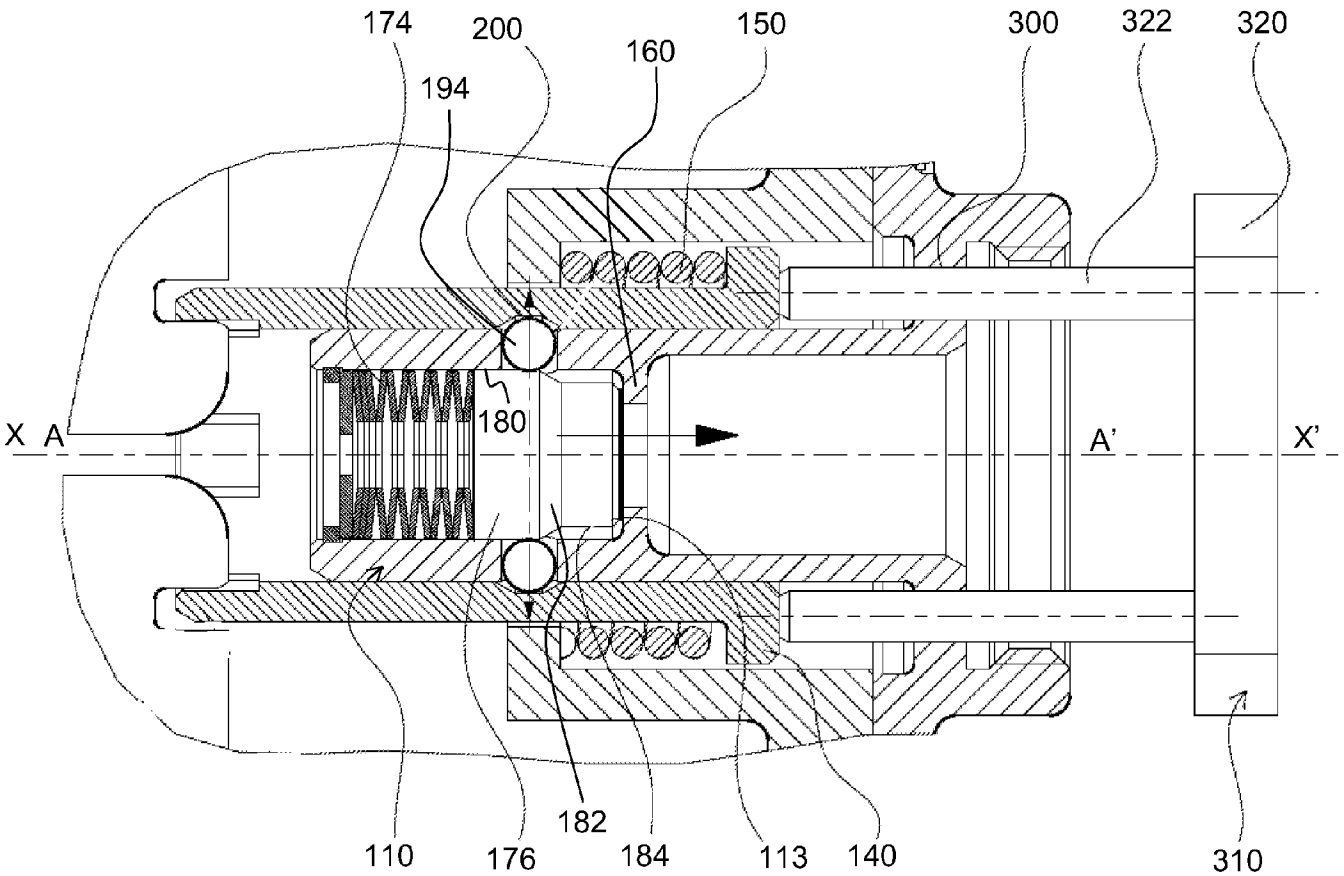
FIG. 10 shows the last phase of the resetting of the locking mechanism of the steering section of FIG. 2.

FIG. 10 shows the last phase of resetting the locking mechanism of the steering section of FIG. 2.

In this last phase of resetting sufficient pressure is applied to the handle 320 to compress the helical spring 150 to such an extent that the groove 200 of the wall of the mobile sleeve comes to face the blocking balls 194 which can position themselves on the said groove 200, pushed by the frustoconical intermediate surface 182 of the locking piston which is itself pushed by the return spring 174 relaxing and which had been compressed during the unlocking of the locking device. The blocking balls 194 therefore find themselves blocked in the groove 200 by the first surface of larger diameter D6 of the locking piston 176 of the locking barrel, placing the locking device in the reset or locked position, with the locking piston 176 bearing against the internal wall 160 of the locking barrel 110, awaiting replacement of the pyrotechnic device.

Figure 11:
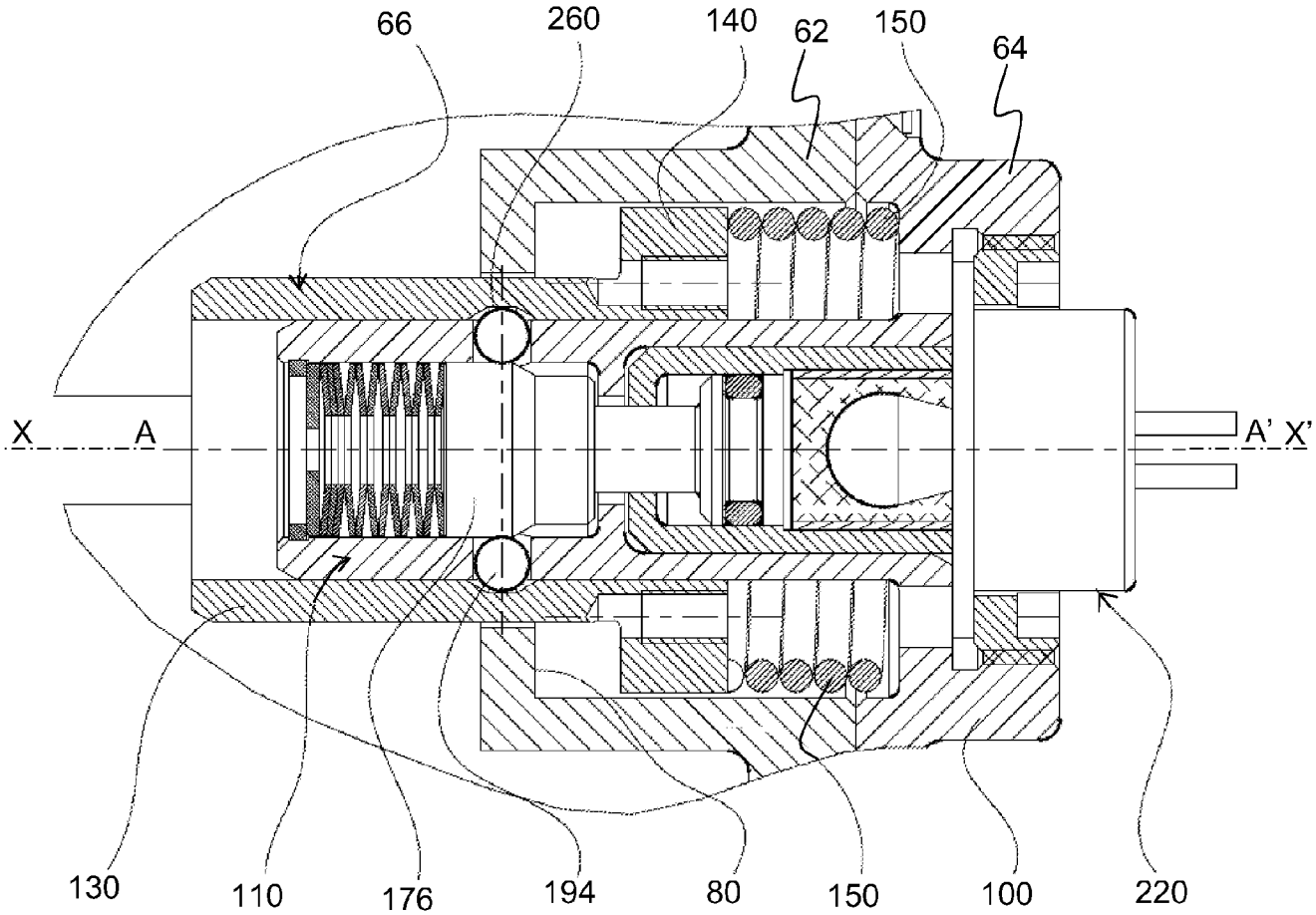
FIGS. 11 and 12 show an alternative form of the locking mechanism of the steering section according to the invention.
Figure 12:
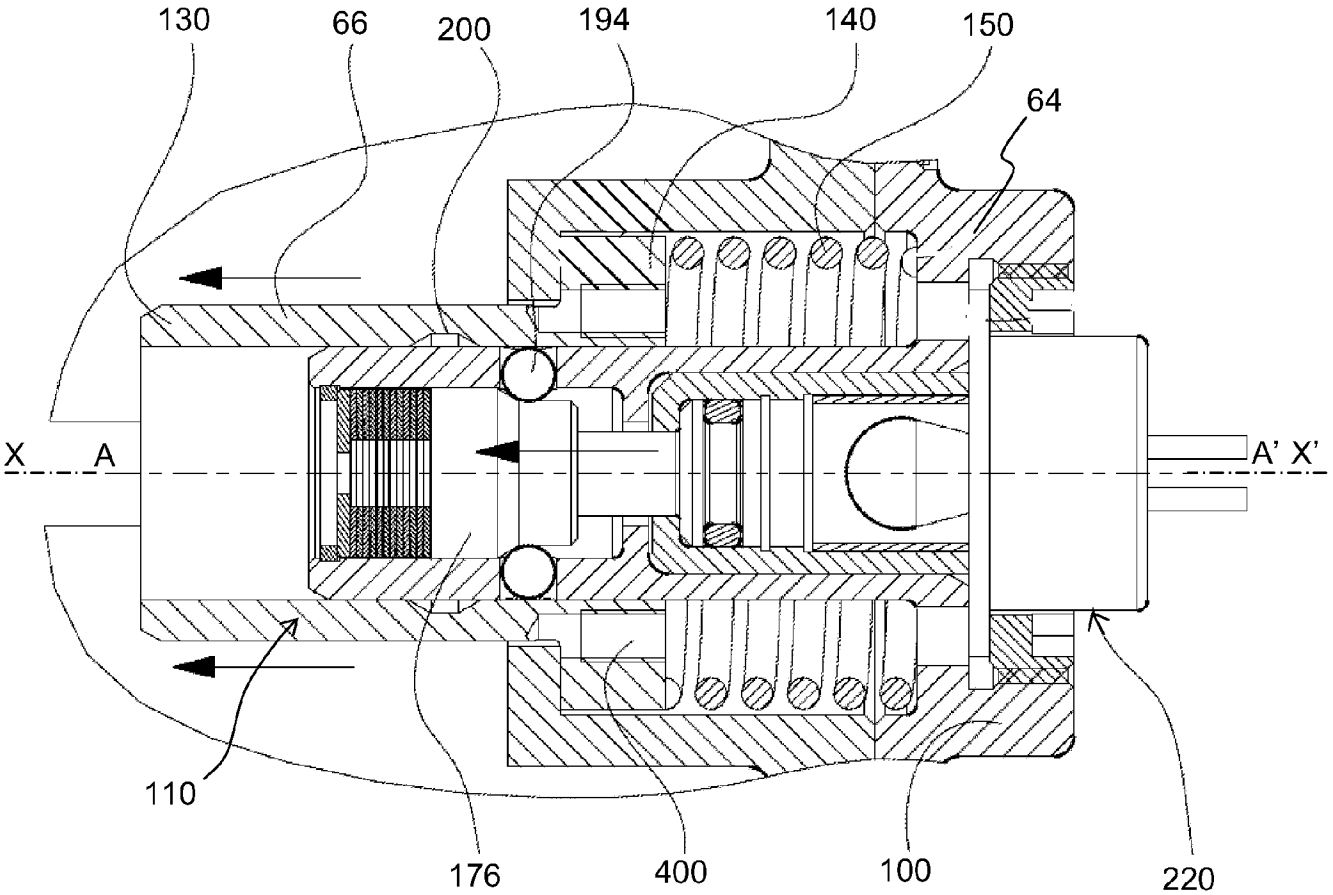

FIGS. 11 and 12 show an alternative form of the locking mechanism of the steering section according to the invention.

FIG. 11 shows the unlocking device in the locked position and FIG. 12 in the unlocked position.

In this alternative form of FIGS. 11 and 12, unlocking of the control surfaces is obtained by a movement of the mobile sleeve 66 in the opposite direction to the direction in which the mobile sleeve moves in FIG. 1*a*. For that, the helical spring 150 is compressed between the flange 140 of the mobile sleeve and the fixing annulus 100 of the fixed sleeve 64. When the translational-locking device that keeps the mobile sleeve 66 in its longitudinal position on the fixed sleeve 64 is triggered or deactivated by activation of the pyrotechnic device, the helical spring 150, now released, relaxes, driving the mobile sleeve 66 towards the outside of the lock support 62. The free end 130 of the mobile sleeve 66 collaborates with the four control surfaces via an intermediate mechanism, not depicted in the figures, in order to release these.

In order to make the alternative form of the device of FIGS. 11 and 12 resettable, the flange 140 of the mobile sleeve comprises a series of threaded holes 400 with axes parallel to the axis XX' and evenly distributed about the axis AA' and opening in the region of the flange of the mobile sleeve 66, and a resetting tool.

The resetting tool essentially comprises a handle having cylindrical rods secured by one of their ends to the handle, the free other ends of the rods being threaded so that they can be screwed into the threaded holes in the flange of the mobile sleeve.

In a first phase of resetting, the threaded ends of the rods are screwed into the threaded holes of the flange and secured to the handle.

The control surfaces are returned to or placed in the folded position, then a strong enough pulling force is applied to the handle to bring the mobile sleeve 66 back towards the fixing annulus, thereby compressing the helical spring 150 to such an extent that the blocking balls 194 enter the groove 200 in the wall of the mobile sleeve, as in the embodiment of FIGS. 9 and 10 for compressing the helical spring 150, and to cause the mobile sleeve 66 to slide along the locking barrel 110 of the fixed sleeve 64 until the locking device is in the locked position.

The invention is not restricted to a set number of control surfaces and can be used in steering sections comprising n control surfaces G1, G2, . . . Gi, . . . Gn, i being the suffix for the control surface and n being greater than 1.

The device generating the unlocking force F can be obtained using various devices and does not restrict it to a pyrotechnic device; for example, the unlocking force F may be generated by an electromagnetic or pneumatic device or by any other device which results in the generation of a force applied to the locking piston 176 of the locking barrel.

The control surfaces locking device which, exhibiting symmetry of revolution and being of reduced dimensions, is advantageously very compact.

When in the locked position, the locking device is able to withstand the phase of high acceleration when fired from the gun barrel. During this phase, the locking piston in the cavity of the locking barrel rests against the pyrotechnic piston if the acceleration is of the "firing-from-gun barrel" type, the said locking piston 176 additionally resting against the pyrotechnic piston can rest twice on the internal wall 160 of the locking barrel 110 of the fixed sleeve 64.

The locking device of the steering section according to the invention is robust, rapid and operates instantaneously thanks to the use of an interchangeable pyrotechnic device, but also thanks to the helical unlocking spring which contains stored energy requiring only to relax.

The locking device is reversible thanks to the intermediate surface of frustoconical shape of the locking piston in the locking barrel and which, under the action of the return spring, tends to position the blocking balls back in the groove of the mobile sleeve when this groove is facing the blocking balls.

The locking device can be fitted to any system with umbrella-type opening.

The invention claimed is:

1. A steering section for a guided munition, the steering section comprising:

a steering body comprising:

an external surface of cylindrical shape about a longitudinal axis XX', and n control surfaces Gn around the longitudinal axis XX', the n control surfaces Gn being in a folded position folded inside the steering body or in a deployed position protruding from the external surface of the steering body to guide the munition, n being a whole number greater than 1, a locking mechanism configured to lock the n control surfaces Gn when in the folded position inside the steering body, said locking mechanism comprising:

a lock support comprising a first tube secured at one end to the steering body, the first tube having an axis of revolution AA' coincident with the longitudinal axis XX', the first tube being closed at an end nearest the n control surfaces Gn by a lock wall comprising a lock opening along the axis of revolution AA', the lock opening having a diameter D2 that is less than an inner diameter D1 of the first tube of the lock support, the lock wall forming an annulus-shaped bearing surface within the lock support, a fixed sleeve having a cylindrical shape about the axis of revolution AA' coinciding with the longitudinal axis XX', the fixed sleeve comprising a fixing annulus in a plane perpendicular to the axis of revolution AA' that is secured to the lock support at an end opposite the end closed by the lock wall, a locking barrel comprising a second tube of circular cross section having an outside diameter D3 passing through the lock opening and comprising a free edge outside the lock support, a mobile sleeve comprising a third tube having a circular cross section and an external diameter D4 surrounding the fixed sleeve, the mobile sleeve being configured to slide longitudinally along the axis of revolution AA' along an external surface of the locking barrel, the mobile sleeve comprising a free end, at the closed end of the first tube nearest the n control surfaces Gn on the outside of the fixed sleeve, collaborating with the n control surfaces Gn to keep the n control surfaces Gn in the folded position inside the steering body and comprising another end, opposite to the free end inside the lock support, comprising a flange of diameter D5 greater than the external diameter D4 of the mobile sleeve, a translational-locking device configured to lock the longitudinal movement along the axis of revolution AA' of the mobile sleeve on the locking barrel, the translational-locking device configured to be deactivated by an unlocking force F to trigger a sliding longitudinal movement of the mobile sleeve on the locking barrel and release of the n control surfaces Gn that move from the folded position into the deployed position, and an unlocking helical spring around the mobile sleeve, the unlocking helical spring configured to cause the mobile sleeve to slide on the fixed sleeve when the locking device is deactivated.

2. The steering section according to claim 1, wherein the locking barrel comprises, in a central part between the two ends of the locking barrel, an internal wall in a plane perpendicular to the axis of revolution AA', the internal wall comprising a circular passage of axis coincident with the axis of revolution AA' to form, between each end of the locking barrel and the internal wall, a cavity of circular cross section comprising a mobile part of the locking device.

3. The steering section according to claim 2, wherein the mobile part of the locking device comprises, between the free edge and an internal wall of the locking barrel, a return spring compressed by a locking piston, the locking piston comprising a first piston surface of diameter D6 that is configured to slide within the locking barrel, the first piston surface being connected by an intermediate surface of frustoconical shape to a second piston surface of diameter D7 that is smaller than the diameter D6 of the first surface of the locking piston.

4. The steering section according to claim 3, wherein the translational-locking device comprises:

blocking holes in a circular wall of the locking barrel, the blocking holes being evenly distributed about the axis of revolution AA' in a plane perpendicular to the axis of revolution AA', blocking balls inserted in the blocking holes, the blocking balls each having a diameter greater than the thickness of the circular wall of the locking barrel, and a groove on a side of an internal surface of the mobile sleeve, wherein, when the locking mechanism is in a locked position, the blocking balls inserted in the blocking holes of the circular wall of the locking barrel in contact with the first piston surface of diameter D6 are inserted partially into the groove of the mobile sleeve blocking the mobile sleeve against longitudinal movement along the fixed sleeve.

5. The steering section according to claim 4, wherein, when the locking mechanism is in the locked position, the unlocking helical spring is compressed between the flange of the mobile sleeve and the lock wall of the lock support, and the unlocking helical spring, on relaxing upon deactivation of the locking device, brings the free end of the mobile sleeve closer to the fixed sleeve.

6. The steering section according to claim 4, wherein, when the locking mechanism is in the locked position, the unlocking helical spring is compressed between the flange of the mobile sleeve and the fixing annulus of the fixed sleeve, and the unlocking helical spring, on relaxing upon deactivation of the locking device, moves the free end of the mobile sleeve further away from the fixed sleeve.

7. The steering section according to claim 4, wherein the locking piston of the mobile part comprises, at the same end of the circular passage of the internal wall of the locking barrel, an application surface on which the unlocking force F acts to compress the return spring and, during a first phase of unlocking of the locking mechanism, applies the second surface of diameter D7 of the locking piston facing the blocking balls which, on withdrawing from the groove of the internal surface of the mobile sleeve, allow the mobile sleeve a longitudinal movement along the locking barrel through relaxation of the unlocking helical spring, in a last unlocking phase, releasing the n control surfaces Gn to allow the n control surfaces Gn to pass from the folded position into the deployed position.

8. The steering section according to claim 7, wherein the locking barrel comprises another cavity between the internal wall of the locking barrel and the fixing annulus secured to the lock support, the other cavity configured to be opened via the fixing annulus comprising a device configured to generate the unlocking force F, the device configured to generate the unlocking force F being secured to the steering body.

9. The steering section according to claim 8, wherein the device configured to generate the unlocking force F is a pyrotechnic device.

10. The steering section according to claim 9, wherein the pyrotechnic device comprises a pyrotechnic tube having a circular cross section having a diameter D8, the pyrotechnic tube configured to slide in the other cavity, the pyrotechnic tube being closed, at the same end as the internal wall of the locking barrel, by a pyrotechnic tube wall comprising a circular opening having a diameter D9, and at the other end of the pyrotechnic tube by another closure wall of circular cross section having a diameter D10 that is greater than the diameter D8 of the pyrotechnic tube.

11. The steering section according to claim 10, wherein the other closure wall of the pyrotechnic device is extended by a cylindrical body having a diameter D12 that is less than the diameter D10 of the other closure wall to create an annulus-shaped bearing surface for a clamping ring, the clamping ring comprising a threaded periphery and comprising a passage through the clamping ring, for passage of the cylindrical body of the pyrotechnic device.

12. The steering section according to claim 11, wherein the pyrotechnic tube comprises:

a pyrotechnic piston, between the pyrotechnic tube wall comprising the circular opening and the other closure wall, configured to slide in a fluid-tight manner inside the pyrotechnic tube, the pyrotechnic piston reducing in diameter to pass through the circular opening in the wall of the pyrotechnic tube, an igniter and a pyrotechnic charge forming, with the pyrotechnic piston, a pyrotechnic chamber, and an O-ring seal surrounding the pyrotechnic piston, the O-ring ensuring that the pyrotechnic chamber is fluid-tight.

13. The steering section according to claim 12, wherein the pyrotechnic piston is in contact, via the application surface on which the unlocking force F acts, with the locking piston in the locking barrel of the fixed sleeve, such that the locking piston is not in direct contact with the internal wall of the locking barrel, and wherein the pressure of the contact between the locking piston and the pyrotechnic piston of the pyrotechnic device is applied by the return spring compressed between the closure ring secured to the free end of the locking barrel and the locking piston.

14. The steering section according to claim 8, wherein the device configured to generate the unlocking force F is an electromagnetic device.

15. The steering section according to claim 8, wherein the device configured to generate the unlocking force F is a pneumatic device.

16. A tool for resetting the locking of the locking mechanism of the steering section according to claim 5, wherein, when the unlocking helical spring between the flange of the mobile sleeve and the lock wall of the lock support is relaxed and the flange of the mobile sleeve is in abutment against an internal shoulder of the fixing annulus of the fixed sleeve, a blocking mechanism comprising a series of holes, each having an axes parallel to the longitudinal axis XX', passing through the fixing annulus of the fixed sleeve and distributed evenly about the axis of revolution AA' and opening in the region of the flange of the mobile sleeve, said tool comprising:

a handle comprising cylindrical rods secured to the handle and distributed on the handle such that when a rod enters a respective hole of the fixing annulus, pressure applied to the handle and transmitted via the cylindrical rods to the flange compresses the unlocking helical spring to reset the locking device.

17. The tool according to claim 6, wherein, when the unlocking helical spring has relaxed between the flange of the mobile sleeve and the fixing annulus of the fixed sleeve, the flange of the mobile sleeve comprises a series of threaded holes each having an axes parallel to the longitudinal axis XX' and distributed evenly about the axis of revolution AA', said tool further comprising:

a handle comprising cylindrical rods secured by one end to the handle, another free end of the cylindrical rods being threaded to be screwed into the threaded holes of the flange of the mobile sleeve and secured to the handle, a pulling force being applied to the handle to bring the mobile sleeve back towards the fixing annulus, which compresses the unlocking helical spring to reset the locking device.

18. A guided munition, comprising: the steering section according to claim 1.

* * * * *